US010968657B2

(12) United States Patent
Durston

(10) Patent No.: US 10,968,657 B2
(45) Date of Patent: Apr. 6, 2021

(54) X-MID GEOMETRY FOR A TREKKING POLE SHELTER

(71) Applicant: Daniel Josiah Durston, Golden (CA)

(72) Inventor: Daniel Josiah Durston, Golden (CA)

( * ) Notice: Subject to any disclaimer, the term of this patent is extended or adjusted under 35 U.S.C. 154(b) by 0 days.

(21) Appl. No.: 16/716,645

(22) Filed: Dec. 17, 2019

(65) Prior Publication Data

US 2020/0208431 A1 Jul. 2, 2020

Related U.S. Application Data

(60) Provisional application No. 62/784,932, filed on Dec. 26, 2018.

(51) Int. Cl.
*E04H 15/00* (2006.01)
*E04H 15/60* (2006.01)
*E04H 15/54* (2006.01)

(52) U.S. Cl.
CPC ..... *E04H 15/00* (2013.01); *E04H 15/54* (2013.01); *E04H 15/60* (2013.01)

(58) Field of Classification Search
CPC ..... E04H 15/00; E04H 15/58
See application file for complete search history.

(56) References Cited

U.S. PATENT DOCUMENTS 2,263,867 A * 11/1941 Barnard ..... E04H 15/04 135/90
3,060,949 A * 10/1962 Moss ..... E04H 15/58 135/87
3,468,321 A * 9/1969 Thompson ..... E04H 15/30 135/95
3,741,224 A * 6/1973 Clelland ..... E04H 15/00 135/87
5,477,876 A * 12/1995 Moss ..... E04H 15/26 135/100
7,316,239 B2 * 1/2008 Yang ..... E04H 15/003 135/117
7,841,356 B2 * 11/2010 Shires ..... E04H 15/36 135/136
8,684,020 B1 * 4/2014 Shires ..... E04H 15/00 135/87
2008/0302403 A1 * 12/2008 Stewart ..... E04H 15/04 135/114
2020/0165835 A1 * 5/2020 Shires ..... E04H 15/26

* cited by examiner

*Primary Examiner* — Noah Chandler Hawk

(57) ABSTRACT

A lightweight shelter for hikers that uses two trekking poles for support. This shelter includes an outer canopy (or "fly") that is rectangle shaped at the base, and a sleeping area which is uniquely positioned on a diagonal relative to the rectangular outer wall. This shelter also includes a ridgeline supported by two trekking poles which are positioned on the crossing diagonal to the sleeping area and inwards from the base of the outer wall such that this shelter can erect into a stable position without additional support beyond what is provided by the canopy.

2 Claims, 4 Drawing Sheets

X-MID GEOMETRY FOR A TREKKING POLE SHELTER

CROSS-REFERENCE TO RELATED APPLICATIONS

This application claims the benefit of U.S. Provisional Application No. 62/784,932, filed Dec. 26, 2018 by the same inventor.

STATEMENT REGARDING FEDERALLY SPONSORED RESEARCH OR DEVELOPMENT

The inventor claims no sponsorship or support of any kind, from any other party.

FIELD

The present application is in the field of portable shelters (e.g. tents and tarps) such as those used by backpackers.

BACKGROUND

Lightweight hikers often use portable shelters which incorporate their trekking poles as the structure of that shelter for the purpose of saving weight. These trekking pole designs are typically lighter than a traditional tent because they avoid the weight of dedicated tent pole set. However, trekking pole shelters remain less popular than tents with traditional tent poles due in large part to disadvantages commonly associated with trekking pole tents; most notably the complex pitching process that most trekking pole designs require. Other disadvantages also common to trekking pole designs including limited headroom, poor structural robustness, and interference in the doorways or floor area by the positioning of the trekking pole(s).

Existing trekking pole based designs can be complex to pitch for many reasons. Some of the most common reasons are (1) the base of the canopy has a complex shape (e.g. many sides, or non-symmetrical, or non-intuitive angles), (2) the shelter has many undefined dimensions (e.g. height, angles) where measuring or estimating is required, (3) the structure is not stable while partially assembled so it requires on-going support from the user during pitching, and (4) the completed structure is not independently robust and thus requires additional support from guylines. As such, achieving an good pitch often requires extensive trial and error, or substantial experience with that shelter.

Simpler trekking pole designs which avoid much of this pitching complexity are less common, but some designs do exist which are based around a simpler rectangle shape which requires fewer estimates of stake positions. Of these, the four sided pyramid design is the most common where a single pole at or near the center provides the structure and this central pole position further reduces other guesswork (e.g. the canopy will limit the pole height so pre-measuring is not required). Despite greater simplicity, the popularity of this geometry is inhibited by other fundamental downsides including limited headroom from using only one pole, and the central location of that pole typically interferes in the doorway and/or sleeping area.

As such, users of trekking pole shelters have generally had to choose between difficult to pitch designs or simpler designs with limited headroom. There have been attempts to retain the simplicity of a rectangle based design while alleviating the lack of headroom by using two trekking poles inside a rectangle. However, prior designs using two trekking poles inside of a rectangle have included other undesirable downsides. These two poles are sometimes positioned at or near the edges of the rectangle (e.g. A-frames or offset A frames) which adds headroom but with the downsides of (1) steep walls that are poor in high winds, (2) instability during the pitch as the peaks are not stable without additional guylines, (3) hassle and weight from mandatory guylines to support the steep walls and (4) a need to pre-measure the pole lengths. Of the few trekking pole designs that use both a rectangle and two poles located substantially inward from the walls, all of them have positioned those poles atop of the floor where they interfere within the sleeping area of that shelter. Thus, there is a need for a trekking pole design which preserves the simplicity of the pyramid design while avoiding many or all of the aforementioned downsides common to trekking pole shelters.

BRIEF SUMMARY OF THE INVENTION

This invention is an improved geometry for a rectangle based trekking pole supported shelter which avoids nearly all of the common downsides of existing trekking pole shelters. This invention uses a rectangle based outer canopy and uniquely rotates the sleeping area onto a diagonal inside that rectangular canopy, unlike any prior art. Two trekking poles support the canopy. These poles are positioned to form a ridgeline on the opposite diagonal as the sleeping area and thus crossing over the sleeping area for good headroom. In the overhead view, the diagonal floor and opposite diagonal ridgeline cross to form an "X" shape. The poles defining the ridgeline are located adjacent to the sleeping area and set substantially back from the edges of the rectangle base, such that the shelter can form a stable structure without any required supporting guylines. In essence, the invention is a rectangle based tent where the occupant(s) sleep on one diagonal and the two poles form a ridgeline on the opposite diagonal (FIG. 1).

This unique geometry solves nearly all of the common downsides of trekking pole tents because it offers good headroom, a simple to stake rectangle based canopy, and the pole locations inside the rectangular base avoid the need to measure pole lengths, are stable throughout the pitch, require no mandatory guylines, and do not interfere in the doorways nor upon the floor area. Overall, this invention is an unique geometry that combines nearly all of the advantages found in a wide variety of trekking pole designs while avoiding nearly all of the common disadvantages. As such, it substantially improves the user experience that a trekking pole supported tent can offer. These features and advantages will become apparent in the detailed description below and accompanying drawings.

DETAILED DESCRIPTION OF THE INVENTION

Figure 1:
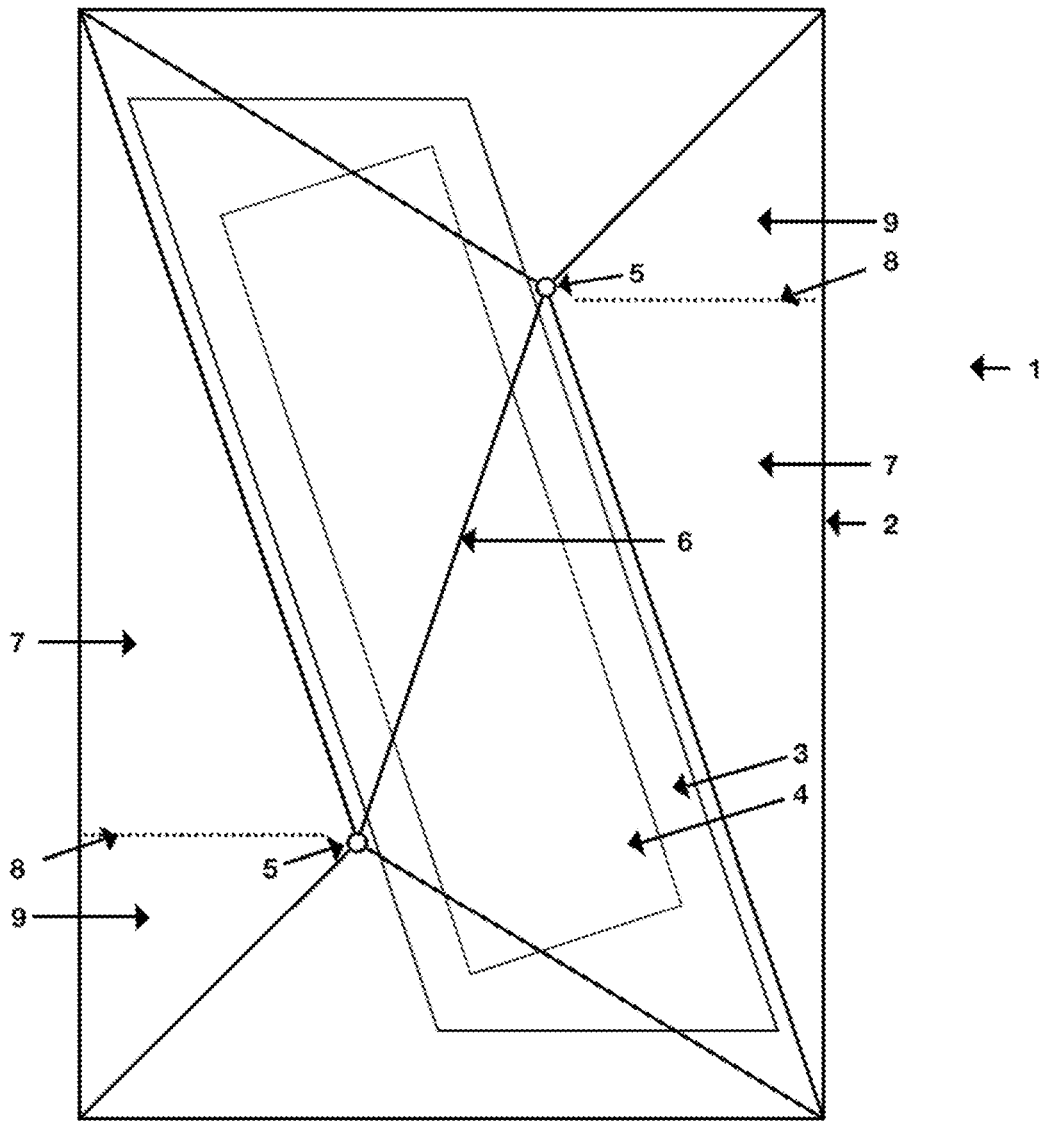
FIG. 1 is a top plan view showing the three key shelter features (rectangle base, diagonal sleeping area, two poles positioned inside the rectangle to form a ridgeline on the opposite diagonal as the floor).
Figure 2:
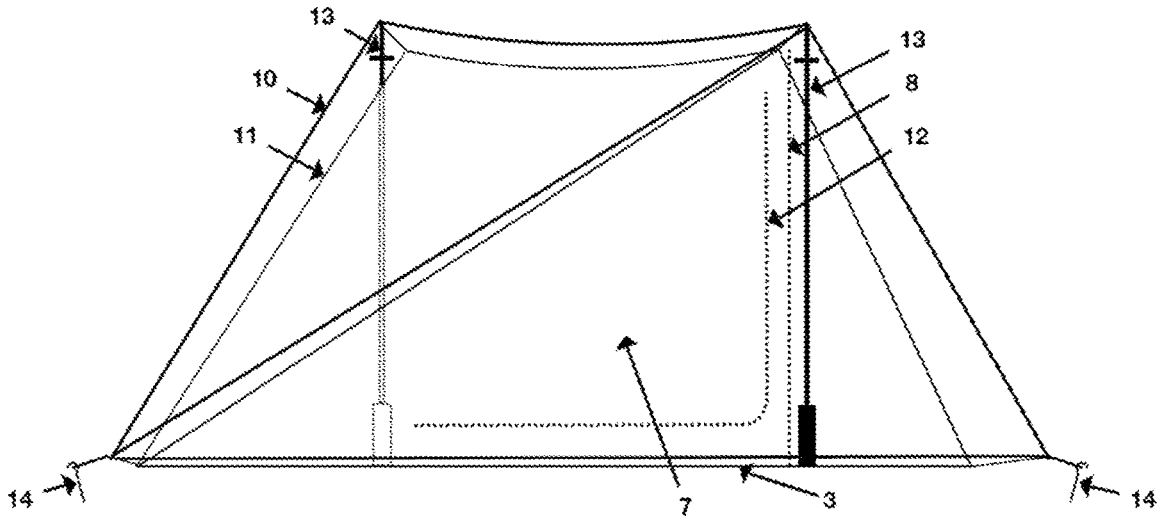
FIG. 2 is a side perspective (long side) of the shelter showing doorways.

Referring FIGS. 1 and 2, this is a design for a lightweight backpacking shelter 1 that uses trekking poles 13 and a unique geometry to avoid numerous problems common to this style of shelter. The invented shelter 1 combines three key features, which are a rectangular base 2, a sleeping area 3 positioned on a diagonal inside that rectangular base 2 (i.e. not orthogonal to any side), and a ridgeline 6 formed in the canopy 10 that is also positioned on a diagonal relative to the rectangular base and crossing over the sleeping area 3. This ridgeline 6 is supported by two trekking poles 13 which connect to the canopy 10 at two peaks 5. These peaks 5 are located adjacent to the sleeping area 3 and set back far enough inside the rectangular base 2 so that the shelter 1 can form a stable structure without requiring other forms of support such as guylines (see FIG. 1).

The canopy 10 (or "fly" or "outer wall") is commonly constructed from woven fabric but can be made from a variety of weather proof or weather resistant materials. The canopy 10 is approximately rectangular at the base 2 (i.e., approximately 90 degrees at all four corners) because a rectangle is intuitive for users to stake 14 out accurately compared to other quadrilateral shapes and shapes with greater than four sides. It will be understood that the shape of the base 2 may vary slightly from an exact rectangle (e.g. the angles inside each corner may vary from about 85 to 95 degrees) for a variety of possible reasons such as stretch in the fabric, manufacturing variances, or irregular terrain, but the base 2 shape will be close enough to a rectangle that a user can stake out the shelter 1 based on that concept.

The dimensions of the rectangular base 2 will vary based on the intended size of the shelter, but will generally be long enough to accommodate adult occupants (e.g. the length of the rectangle will typically be ninety to one hundred and ten inches in length). The width of the rectangular base 2 will vary widely depending on the number of intended occupants, as a wider base 2 allows for a wider sleeping area 3 which can accommodate a greater number of occupants (see FIG. 3). A base 2 width of fifty five to seventy five inches is typical for one occupant because it allows for a sleeping area 3 that a wide enough to easily accommodate one common size (twenty inch wide) sleeping pad 4. For two occupants, a base 2 width of seventy to ninety inches is typical as that allows for a sleeping area 3 that accommodates two common size sleeping pads 4.

The canopy 10 rises up to two peaks 5 which are supported by two trekking poles 13. One trekking pole 13 is oriented vertically or near vertically below each peak 5. A key design element is that the trekking poles 13 and corresponding peaks 5 are located substantially inside the rectangular base 2, rather than being located along or near the perimeter of the shelter 1 because this position allows the peaks 5 to be anchored into a stable position by support from the canopy 10 on all sides. More specifically, the canopy 10 joins each peak 5 to the three nearby corner stakes 14 and the other peak 5, and since the each peak 5 is located substantially within the area bound by those connected points, it gains sufficient anchoring from all sides. To achieve sufficient anchoring, the peak 5 locations are set back at least ten inches from the all sides of the rectangular base 2, with the setback more commonly being twenty to thirty inches from the closest two sides of base 2 in exemplary form. This location balances the greater structural stability that comes with additional setback, with the need to keep the trekking poles 13 far enough apart to provide a reasonably wide sleeping area 3 crossing between the vertical trekking poles 5. When constructed in the manner described, the peaks 5 require no additional support for typical use, but optional supplementary support such as guylines may be provided to further support the shelter 1.

The two peaks 5 are also positioned in such a way to form a ridgeline 6 in the canopy 10 which is located on a diagonal inside the rectangular base 2 (i.e. not orthogonal to any side) as shown in FIG. 1. The ridgeline 6 crosses over the sleeping area 3 and is long enough so that the sleeping area 3 can be wide enough to accommodate the intended number of occupants. A key design element is that the sleeping area 3 is also positioned on a diagonal inside the rectangular base 2 but crossing under the ridgeline 6, such that the diagonal sleeping area 3 and diagonal ridgeline 6 cross to form an X pattern inside the rectangular base 2 in the overhead view (FIG. 1). The distance along the ridgeline 6 between the two trekking poles 13 is typically forty to sixty inches (for one occupant) or fifty to seventy inches (for two occupants), as that allows for a sleeping area that is twenty five to thirty five inches wide (for one occupant) or forty to fifty five inches wide (for two occupants).

The height of the canopy 10 is set by trekking poles 13 and thus is normally limited to a height no greater than fifty five inches since commercially available trekking poles 13 are rarely able to extend taller than this. Typical heights for the canopy peaks 5 are forty to fifty five inches. The trekking poles 13 can interface with the peaks 5 in a variety of ways, including being oriented with the handles up and pushing directly on the canopy, or with the tips oriented upward and connecting into a grommet inside the peaks 5. It is also possible to use two trekking poles 13 at each of one or both peaks 5. This allows the lower ends of those trekking poles 13 to be splayed apart which may be more convenient than one vertical trekking pole 13 in some use cases. Further, while trekking poles 13 are commonly used as support in this style of shelter 1, other types of support may be used such as folding poles, or suspending the peaks 5 via external cords instead of internal support.

Figure 3:
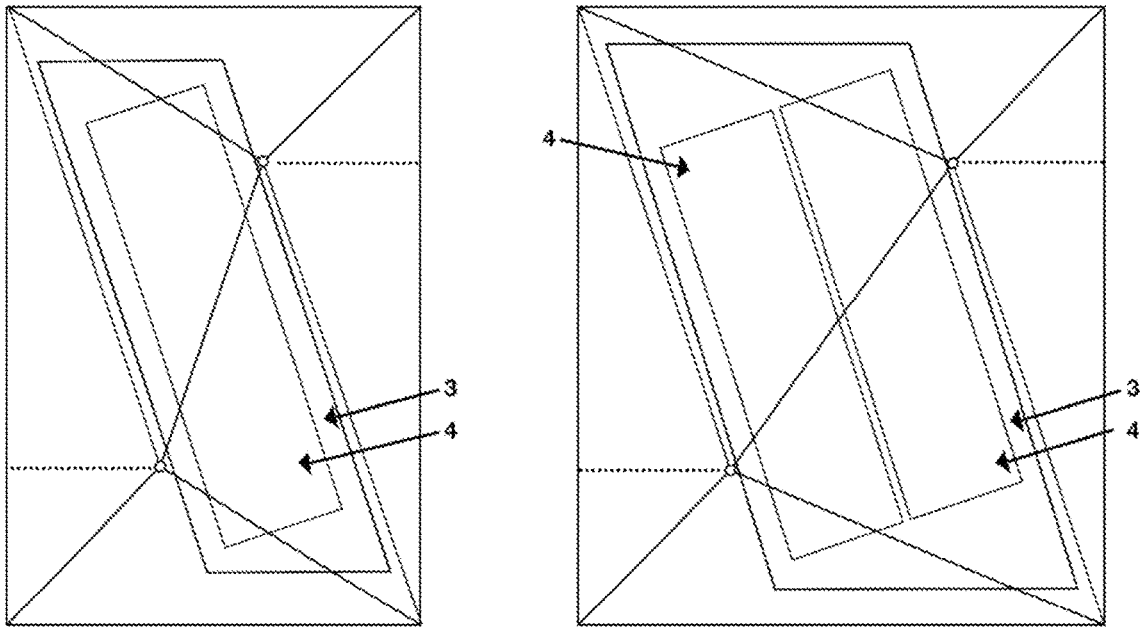
FIG. 3 is a top plan view showing how the design can be adapted to fit various number of occupants.

A novel element of this invention is that the sleeping area 3 is located such that the occupants lie on a diagonal inside the rectangular base 2 of the shelter 1, as indicated by the location of the sleeping pad(s) 4 (see FIG. 3). In exemplary form, the sleeping area 3 is situated on a diagonal inside the rectangular base 2 such that the longer sides of the sleeping area 3 are typically rotated fifteen to twenty five degrees relative to the longer sides of the rectangular base 2, and with the sleeping pads 4 typically used by occupants on this same angle. This degree of rotation allows for all of the sleeping area 3 to protected by the canopy 10 from vertical rainfall even when the doorways are open. In other embodiments, the sleeping area 3 may be rotated further (up to forty five degrees) depending on other design considerations. The position of the sleeping pads 4 will always cross between the two poles and below the ridgeline 6, which leaves vestibules 9 (non-sleeping areas) on the outward side of both poles 13. These vestibules 9 can be useful for gear storage, cooking and other uses (see FIG. 1).

Figure 4:
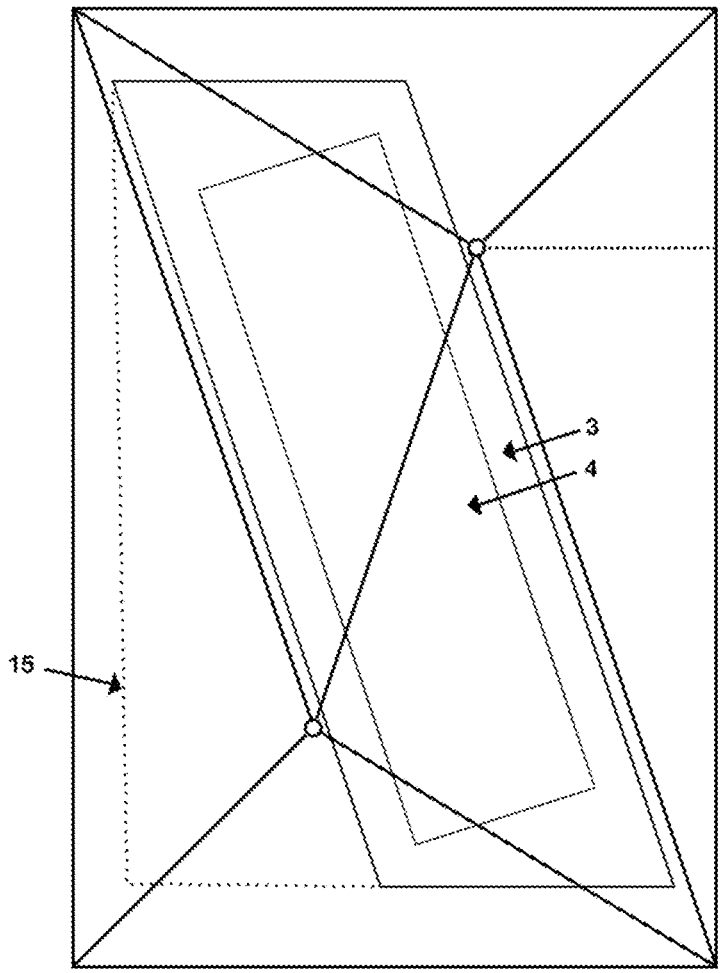
FIG. 4 is a top plan view showing that the floor can be expanded to fill one or both vestibules while the sleeping position remains diagonal.

The sleeping area 3 provided by the canopy 10 can be used without a floor (i.e. only the occupant(s) and sleeping pad(s) 4), or even with only the occupant and no sleeping pad 4, but most commonly the sleeping area 3 will be equipped with some type of a floor to fill the space. Commonly the floor will have a parallelogram shape (see FIGS. 1 and 3) to increase the length of the sleeping area 3, but other floor shapes are possible such as a rectangle. In some embodiments, the shelter may have an extended floor 15 which expands beyond the sleeping area 3 to fill one or both of the vestibules 9 (see FIG. 4). Even with this, the key design element of a diagonal sleeping area 3 crossing below the ridgeline 6 is still present.

The floor may be a separate piece of material (e.g. a groundsheet) to provide protection from the ground, but more commonly the tent will include a waterproof floor that connects to the canopy 10 in a permanent or removable fashion. A common design is to equip the shelter 1 with a separate inner tent 11, which includes a floor sewn to walls and a roof to form a fully contained inner tent 11, which then connects inside the weatherproof canopy 10 in a fashion that is typically removable (e.g. connects via buckles or clips). Alternatively, an incomplete inner tent 11 (e.g. no roof panels and four or fewer side walls) may be permanently sewn inside the canopy 10 which is often referred to as a "hybrid" or "singlewall" design. Regardless of how the floor connects and what supplementary internal walls are provided, the key attribute of the diagonal sleeping area 3 inside the rectangle base 2 and crossing below the ridgeline 6 remains.

The canopy 10 will typically have two doorways 7 to enable access. In exemplary form, one doorway 7 is located on each of the longer two sides of the canopy (see FIG. 2). This location allows for large doorways 7 that are not blocked by the trekking poles 13. However, it is also possible to equip the canopy 10 with only one doorway 7 and/or provide those doorway(s) 7 on the shorter end walls of the shelter 1. The doorways 7 are commonly opened via canopy zippers 8 but can also be opened otherwise (such as using clips or buckles). In instances where the shelter has an inner tent 11 wall behind the canopy doorway(s) 7, there will also be a doorway into the inner tent 11 located behind the canopy door 7 which is also typically operated by a zipper 12.

It is understood that the dimensions, geometry and features described here are variable and should be given reasonable interpretation. Those familiar with shelter design will find it apparent that the previous described embodiments are exemplary versions only, and other variations may exist which fall within the scope of this invention. The presently preferred embodiments are examples of how to make and use the invention, and are presented to enable rather than limit the invention. The scope of the invention supported by the present disclosure should be construed within the scope of what it teaches to those skilled in the art. This scope is defined by the following claims.

What is claimed:

1. A shelter for backpackers or other outdoor users where the canopy of the shelter is substantially rectangle shaped at the bottom (base), and the floor is located substantially diagonally inside that rectangular base such that two vestibules are formed in two opposite corners within the rectangular base and generally orthogonal to the diagonal axis of the floor, and where two vertical poles are positioned in those opposite corner vestibules (one in each) and substantially inside the rectangular base to support peaks that define a ridgeline which is diagonal inside the rectangular base and crossing over the floor, and with those peaks located substantially inside the rectangular base of the canopy so that the shelter can be erected into a stable position without requiring additional support beyond what is provided by canopy of the tent.

2. A shelter for backpackers or other outdoor users where the canopy of the shelter is substantially rectangle shaped at the bottom (base) and the floor is parallelogram shaped and positioned substantially diagonally inside the rectangular base such that the two longest sides of the parallelogram are not parallel to any side of the rectangular base, such that two vestibules are formed in two opposite corners within the rectangular base and generally orthogonal to the diagonal axis of the floor, and where two vertical poles are positioned in those opposite vestibule corners (one in each) and substantially inside the rectangular base to support peaks that define a ridgeline which is diagonal inside the rectangular base and crossing over the floor, and with those peaks located substantially inside the rectangular base of the canopy so that the shelter can be erected into a stable position without requiring additional support beyond what is provided by canopy of the tent.

* * * * *